US010851644B2

(12) United States Patent
Legendre et al.

(10) Patent No.: US 10,851,644 B2
(45) Date of Patent: Dec. 1, 2020

(54) DOWNHOLE DETECTION OF CUTTINGS

(71) Applicant: Schlumberger Technology Corporation, Sugar Land, TX (US)

(72) Inventors: Emmanuel Legendre, Clamart (FR); Alexandre Abellan, Clamart (FR); Mathieu Tarrius, Clamart (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 2 days.

(21) Appl. No.: 16/061,165

(22) PCT Filed: Dec. 14, 2016

(86) PCT No.: PCT/EP2016/002105
§ 371 (c)(1),
(2) Date: Jun. 11, 2018

(87) PCT Pub. No.: WO2017/102079
PCT Pub. Date: Jun. 22, 2017

(65) Prior Publication Data

US 2018/0363450 A1 Dec. 20, 2018

(30) Foreign Application Priority Data

Dec. 16, 2015 (EP) ..... 15290319

(51) Int. Cl.
*E21B 47/09* (2012.01)
*E21B 47/095* (2012.01)

(52) U.S. Cl.
CPC ..... *E21B 47/095* (2020.05)

(58) Field of Classification Search
None
See application file for complete search history.

(56) References Cited

U.S. PATENT DOCUMENTS 5,130,950 A 7/1992 Orban et al.
5,214,251 A 5/1993 Orban et al.
5,250,806 A 10/1993 Rhein-Knudsen et al.
(Continued)

FOREIGN PATENT DOCUMENTS

EP 0671547 A1 9/1995
WO 9900575 1/1999
WO 2009072091 6/2009

OTHER PUBLICATIONS

International Search Report and Written Opinion issued in International Patent application PCT/EP2016/002105, dated Mar. 31, 2017. 13 pages.

(Continued)

*Primary Examiner* — D. Andrews

(57) ABSTRACT

A method includes emitting, with one or more sensors of a downhole tool disposed in a borehole, an excitation signal. The method also includes detecting, with the one or more sensors, a returned signal resulting from an interaction of the excitation signal with the borehole. The method further includes estimating a noise of the returned signal. The method also includes quantifying a probability that the estimated noise is not a white noise of the borehole. The method further includes identifying drill cuttings in a predetermined location of the borehole based on said quantification.

18 Claims, 6 Drawing Sheets

(56) References Cited

U.S. PATENT DOCUMENTS

| | | | | |
|---|---|---|---|---|
| 6,206,108 | B1 | 3/2001 | MacDonald et al. | |
| 6,768,106 | B2 * | 7/2004 | Gzara | E21B 44/00 250/269.3 |
| 2009/0145661 | A1 * | 6/2009 | Jeffryes | E21B 37/00 175/46 |
| 2011/0069583 | A1 | 3/2011 | Camwell et al. | |
| 2012/0069705 | A1 | 3/2012 | Zhao | |
| 2014/0278113 | A1 * | 9/2014 | Chok | E21B 49/088 702/13 |
| 2016/0108724 | A1 * | 4/2016 | Jarrot | E21B 47/122 702/191 |
| 2019/0226323 | A1 | 7/2019 | Pedrycz et al. | |

OTHER PUBLICATIONS

Extended Search Report Rule 62 EPC issued in European patent application 15290319.1 dated Jun. 13, 2016. 7 pages.
Office Action issued in U.S. Appl. No, 15/877,263 dated Apr. 23, 2020, 6 pages.

* cited by examiner

DOWNHOLE DETECTION OF CUTTINGS

BACKGROUND

This disclosure relates to downhole drilling operations, and more particularly, to detecting drill cuttings in downhole drilling operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light.

A drill string that includes a drill bit may drill a well or borehole through a geological formation. To cool and/or lubricate the drill bit, a drilling fluid pump may pump drilling fluid downward through the center of the drill string to the drill bit. At the drill bit, the drilling fluid may then exit the drill string through ports. The drilling fluid may flow upward through an annulus between the drill string and the geological formation toward the surface. In this manner, the drilling fluid may carry drill cuttings away from the bottom of the borehole. Drill cuttings or "cuttings" include small pieces of rock or other debris that break away from the geological formation as a result of drilling.

The cuttings may create undesirable artifacts on measurements taken by one or more sensors (e.g., acoustic sensors, ultrasonic sensors, electromagnetic sensors, etc.) of a downhole tool of the drill string. For example, when a cutting is positioned in front of a sensor, the cutting may cause an abrupt change in the measurement due to a change in impedance. This abrupt change may cause a cutting-induced artifact in the measurement of the sensor.

It is known to perform cutting detection by using outlier-detection algorithms (i.e. algorithms for detecting abnormal values of the sensor measurement) to account for cutting-induced artifacts. The outlier-detection algorithms may assume that a frequency of the abrupt changes is sufficiently high to be detected over a background signal and that a signal-to-noise ratio (SNR) is strong. However, such assumptions not being always realized when drilling wells.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the disclosure relate to downhole drilling operations, and more particularly, to detecting drill cuttings in downhole drilling operations. In a first embodiment, a method includes emitting, with sensors of a downhole tool disposed in a borehole, an excitation signal and detecting, with the sensors, a returned signal resulting from an interaction of the excitation signal with the borehole. The method further includes estimating a noise of the returned signal. and quantifying a probability that the estimated noise is not a white noise of the borehole. Based on the quantification, drill cuttings in a location of the borehole (in particular in front of the sensors) are identified.

In a second embodiment, a system includes a downhole tool disposed in a borehole comprising sensors for emitting an excitation signal in the borehole and detecting a returned signal resulting from an interaction of the excitation signal with the borehole. The system also includes a processor for estimating a noise of the returned signal, quantifying a probability that the estimated noise is not a white noise of the borehole, and identifying drill cuttings in a location of the borehole based on the quantification.

In a third embodiment, a tangible, non-transitory, machine-readable medium includes machine readable instructions to emit, with sensors of a downhole tool disposed in the borehole, an excitation signal and to detect, with the sensors, a returned signal resulting from an interaction of the excitation signal with the borehole. Instructions are also set to estimate a noise of the returned signal, quantify a probability that the estimated noise is not a white noise of the borehole and identify drill cuttings in a location of the borehole based on the quantification.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are examples of the presently disclosed techniques. Additionally, in an effort to provide a concise description of these embodiments, a complete listing of features of an actual implementation may not be described in the specification. It should be appreciated that in the development of any such actual implementation, as in any engineering or design project, numerous implementation-specific decisions are made to achieve the developers' specific goals, such as compliance with system-related and business-related constraints, which may vary from one implementation to another. Moreover, it should be appreciated that such a development effort might be complex and time-consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of this disclosure relate to downhole drilling operations, and more particularly, to detecting drill cuttings in downhole drilling operations. The disclosed embodiments may enable accurate cutting detection and avoid to reliance upon outlier-detection. In particular, the cutting-detection systems and methods of this disclosure may involve emitting an excitation signal and evaluate whether the returned signal is disturbed due to the presence of cuttings.

Figure 1:
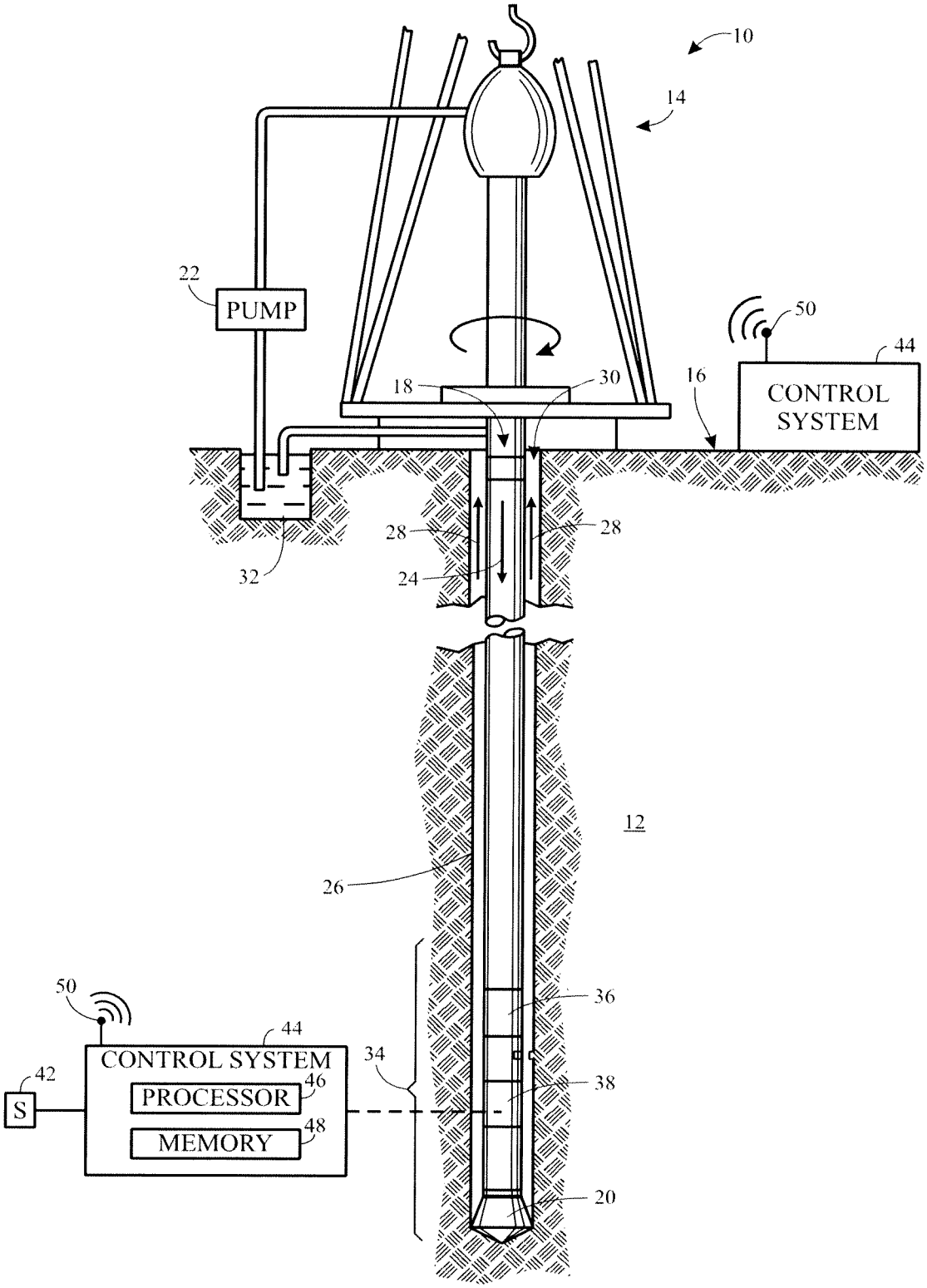
FIG. 1 is a schematic diagram of a drilling system, which may be used to drill a well or borehole through a geological formation, in accordance with an embodiment of the present disclosure.

FIG. 1 is a schematic diagram of a drilling system 10, which may be used to drill a well or borehole through a geological formation 12. In the depicted example, a drilling rig 14 at the surface 16 rotates a drill string 18, which includes a drill bit 20 at its lower end to engage the sub-surface formation 12. To cool and/or lubricate the drill bit 20, a drilling fluid pump 22 may pump drilling fluid, referred to as "mud" or "drilling mud," downward through the center of the drill string 18 in the direction of the arrow 24 to the drill bit 20. At the drill bit 20, the drilling fluid may then exit the drill string 18 through ports. The drilling fluid may then flow in the direction of the arrows 28 through an annulus 30 between the drill string 18 and the geological formation 12 toward the surface 16. In this manner, the drilling fluid may carry drill cuttings away from the bottom of a borehole 26. Drill cuttings or "cuttings" include small pieces of rock or other debris that break away from the geological formation 12 as a result of drilling. Once at the surface 16, the returned drilling fluid may be filtered and conveyed back to a mud pit 32 for reuse.

Additionally, as depicted, the lower end of the drill string 18 includes a bottom-hole assembly 34 that includes the drill bit 20 along with a downhole tool 36, such as a measuring tool, a logging tool, or any combination thereof. Generally, the downhole tool 36 may facilitate determining characteristics of the surrounding formation 12. Thus, in some embodiments, downhole tool 36 may include one or more sensors 42. Further references to the sensor 42 may refer to one or more sensors 42 of the downhole tool 36. In some embodiments, the sensor 42 may include an acoustic sensor (for instance, an ultrasonic pulse-echo transducer), which may perform acoustic measurements returned from the surrounding formation 12. In some embodiments, the sensor 42 may include an electrical sensor (for instance, an electromagnetic transducer or receiver), which may perform electrical measurements (such as galvanic or inductive) returned from the surrounding formation 12.

In some embodiments, a control system 44 may control operation of the downhole tool 36. For example, the control system 44 may instruct the downhole tool 36 to perform measurements using the sensor 42 and/or process the measurements to determine characteristics of the surrounding environment (e.g., formation 12). In some embodiments, the control system 44 may be included in the downhole tool 38. In other embodiments, the control system 44 may be separate from the downhole tool 36, for example, situated in another downhole tool or at the surface 16. In other embodiments, a portion of the control system 44 may be included in the downhole tool 36 and another portion may be located separate from the downhole tool 36.

When at least a portion is separate from the downhole tool 36, information (e.g., measurements and/or determined characteristics) may be transmitted to and/or within the control system 44 for further processing, for example, via mud pulse telemetry system (not shown) and/or a wireless communication system (not shown). Accordingly, in some embodiments, the downhole tool 36 and/or the control system 44 may include wireless transceivers 50 to facilitate communicating information.

To facilitate controlling operation, the control system 44 may include one or more processors 46 and one or more memory devices 48. Further references to "the processor 46" are intended to include the one or more processors 46. In some embodiments, the processor 46 may include one or more microprocessors, one or more application specific processors (ASICs), one or more field programmable logic arrays (FPGAs), or any combination thereof. Additionally, the memory 48 may be a tangible, non-transitory, machine-readable medium that stores instructions executable by and data to be processed by the processor 46. Thus, in some embodiments, the memory 48 may include random access memory (RAM), read only memory (ROM), rewritable flash memory, hard drives, optical discs, and the like.

Figure 2:
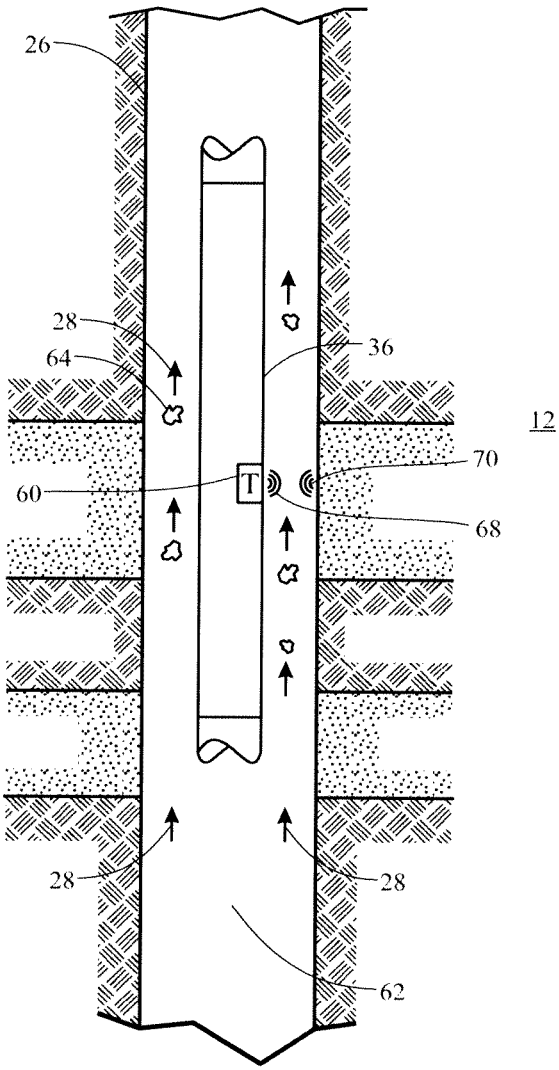
FIG. 2 is a schematic diagram of a downhole tool with an acoustic transceiver in a borehole, in accordance with an embodiment of the present disclosure.

Turning now to FIG. 2, a downhole tool 36 with an acoustic transducer 60 in a borehole 26 in accordance with an embodiment of the present disclosure is illustrated. The borehole 26 may include the drilling fluid 62 provided by the drilling fluid pump 22 flowing in the direction of the arrows 28 through the annulus 30 between the drill string 18 and the geological formation 12 toward the surface 16. The borehole 26 may also include the cuttings 64 that may be traveling in the direction of the arrows 28 due to being carried away by the drilling fluid 62 from the bottom of the borehole 26.

The illustrated downhole tool 36 includes the acoustic transducer 60 (e.g., an ultrasonic pulse-echo transducer). The acoustic transducer 60 may perform acoustic measurements returned from the surrounding formation 12. For example, the acoustic transducer 60 may emit acoustic waves 68 and receive and measure the reflected waves or signals 70 as a result of interactions between the acoustic waves 68 and the surrounding formation 12. The reflected waves 70 may vary depending on the composition or character of the surrounding formation 12.

Figure 3:
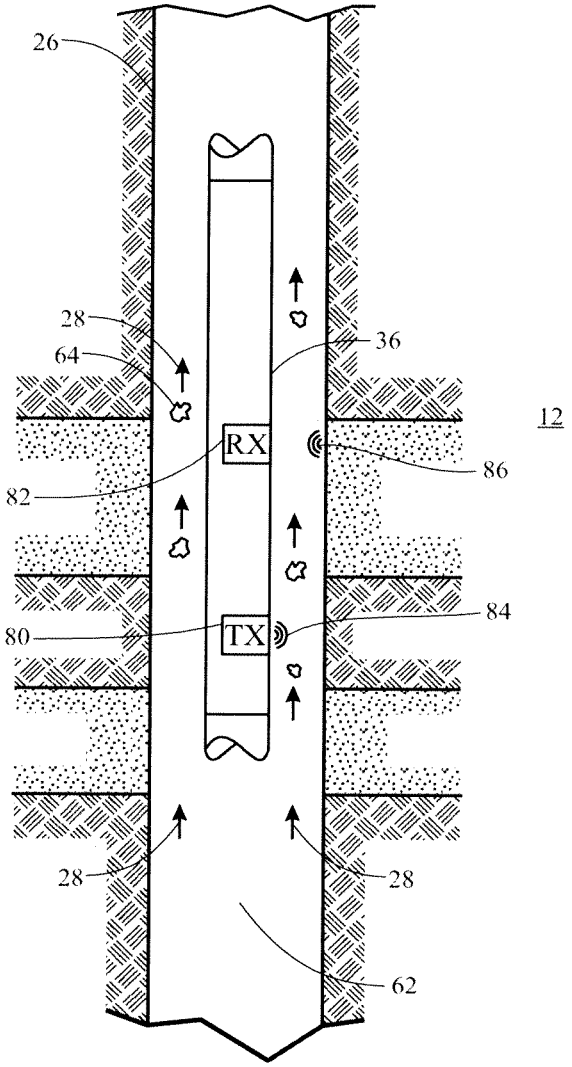
FIG. 3 is a schematic diagram of a downhole tool with an electromagnetic transmitter and receiver, in accordance with an embodiment of the present disclosure is illustrated.

Turning now to FIG. 3, a downhole tool 36 with an electromagnetic transducer 80 and receiver 82 in a borehole 26 in accordance with an embodiment of the present disclosure is illustrated. As in FIG. 2, the borehole 26 may include the drilling fluid 62 and cuttings 64 flowing in the direction of the arrows 28 toward the surface 16.

The illustrated downhole tool 36 includes a sensor 42 includes the electromagnetic transducer 80 and receiver 82. The electromagnetic transducer 80 and receiver 82 may perform electromagnetic measurements returned from the surrounding formation 12. For example, the electromagnetic transducer 80 may emit electromagnetic waves 84 and the receiver 82 may receive and measure the reflected waves or signals 86 as a result of interactions between the electromagnetic waves 84 and the surrounding formation 12. In some embodiments, the downhole tool 36 may include a plurality of receivers 82, which may receive and measure a plurality of reflected waves 86 that are a result of interactions between the electromagnetic waves 84 and the surrounding formation 12. The reflected waves 86 may vary depending on the composition or character of the surrounding formation 12.

Figure 4:
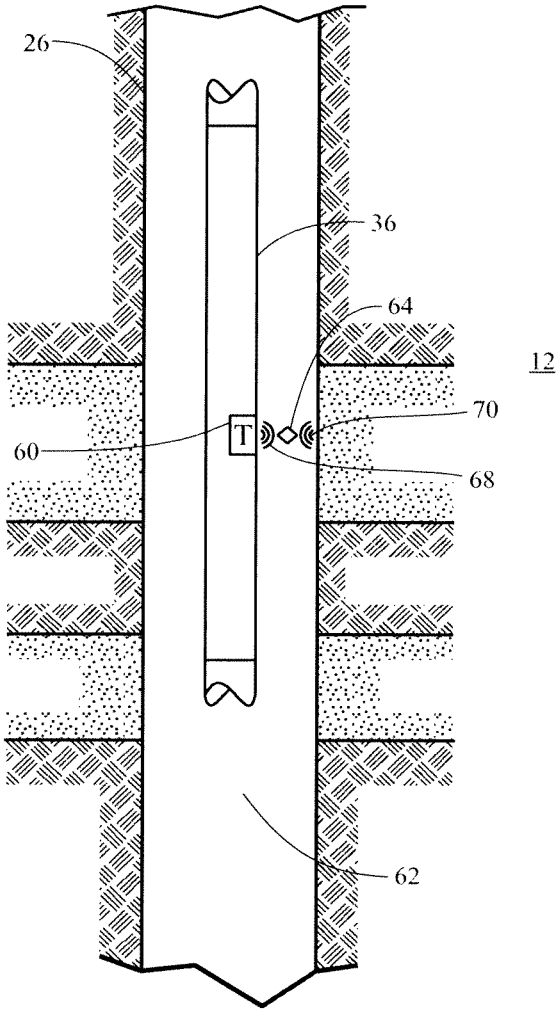
FIG. 4 is a schematic diagram of a downhole tool with an acoustic transceiver, in accordance with an embodiment of the present disclosure.

The cuttings 64 may create undesirable artifacts on measurements taken by the sensor 42 of the downhole tool 36. For example, FIG. 4 is a schematic diagram of a downhole tool 36 with an acoustic transceiver 60 performing an acoustic measurement in accordance with an embodiment of the present disclosure. The cutting 64 is positioned in front of the acoustic transceiver 60 while the acoustic transceiver 60 is measuring the reflected acoustic wave 70. As a result, the cutting 64 interferes with the emitted acoustic wave 68 and/or the reflected wave 70, and causes an abrupt change in the measurement of the reflected acoustic wave 70 due to a change of acoustic impedance. This abrupt change may cause a cutting-induced artifact in the measurement of the reflected acoustic wave 70. When the sensor 42 is an electromagnetic transmitter 80 and receiver 82, the cutting-induced artifact may be caused by an abrupt change in the measurement of the reflected electromagnetic wave 86 due to a change of electrical impedance. The signal induced by the reflected acoustic wave 70 or the reflected electromagnetic wave 86 may not be coherent with an expected signal that would be generated by a wave 70, 86 reflected by the formation in a regular (i.e., cutting-free) measurement acquisition environment. It may thus be desirable to detect cuttings in measurements at least for the purpose of removing the cutting-induced artifacts.

The approach of the disclosure may be to emit an excitation signal and measure a returned signal as a result of the excitation signal interacting with the borehole (i.e., the formation 12 and the drilling fluid inside of the borehole). The measurement may be evaluated to determine whether the measurement was acquired over a time interval during which no abrupt change to the measurement occurred due to a presence of one or more cuttings 64.

Figure 5:
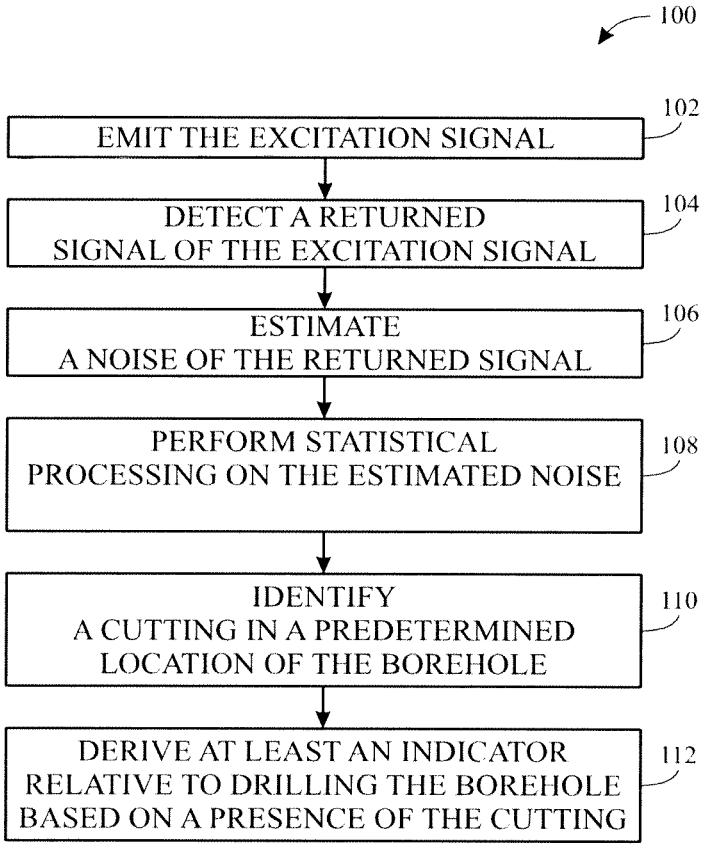
FIG. 5 is a flowchart of a method of cutting detection in accordance with an embodiment of the present disclosure.

FIG. 5 is a flowchart of a method 100 for cutting detection in accordance with an embodiment of the present disclosure. The downhole tool emits (block 102) an excitation signal. In embodiments where the sensor 42 is the acoustic transceiver 62, the acoustic transceiver 62 emits the excitation signal. In embodiments where the sensor 42 includes the electromagnetic transmitter 80, the electromagnetic transmitter 80 emits the excitation signal.

The acoustic and electromagnetic sensors (e.g., transmitters, receivers, etc.) may have a concentrated spatial sensitivity in front of the sensor 42. The sensor 42 may be dimensioned to provide an area of sensitivity on an order of one inch in front of the sensor 42. In some embodiments, the area of sensitivity may be 0.5, 1, 1.5, 2, or 5 inches in front of the sensor 42.

The downhole tool then detects (block 104) a returned signal of the excitation signal. In embodiments where the sensor 42 is the acoustic transceiver 62, the acoustic transceiver 62 receives and detects the returned signal 70. In embodiments where the sensor 42 includes the electromagnetic receiver 82, the electromagnetic receiver 82 receives and detects the returned signal 86. The returned signal may be a result of the excitation signal interacting with the surrounding formation 12. There may be an additional or alternative returned signal that is a result of the excitation signal interacting with the cutting 64.

For an acoustic measurement, a Gaussian pulse may be a viable excitation signal. However, any excitation signal may be used to apply the method according to the disclosure. The frequency of the Gaussian pulse excitation signal may be chosen so that the frequency returned signal corresponds to a frequency response of the acoustic transceiver 60 of the downhole tool 36, and may be measured by the acoustic transceiver.

For an electromagnetic measurement, an appropriate excitation signal may include a sinusoid with a constant amplitude over a square time window. Again, any excitation signal may be used. Because the excitation signal is monofrequency, there is no motivation to assume a dispersion of the impulse response of the borehole in relation to the excitation signal. Still, it may be desirable to modulate the amplitude or frequency of the sinusoidal signal processed over the time interval. Such modulation is however optional.

The excitation signal is a given input sequence s that may be emitted by the sensor 42 for a time interval or duration. The time interval may be determined based on a range of time that may provide a sufficient resolution of the cuttings 64 on the measurement of the sensor 42. In some embodiments, the time interval may be from 10 microseconds (us) to 10 milliseconds (ms) (e.g., 10 us, 100 us, 1 ms, 10 ms, etc.).

The processor then estimates (block 106), taking into account the returned signal detected at block 104, a noise of the returned signal. The estimation of the noise may be performed by modelling a function representing a reconstructed signal, corresponding to an expected returned signal of the borehole interacting with the excitation signal, having at least two adjustable variables, and determining the adjustable variables based on the measured returned signal. By way of example it may be performed using a matched filter theory as explained below based on Equations (1)-(4). Once the reconstructed signal is obtained, the noise is considered to be the difference between the returned signal and reconstructed signal.

More particularly, the estimation may be performed as follows. If no rapid perturbation occurs (e.g., due to cuttings 64 interfering with measurement of the excitation signal), the measured signal y will be the convolution of the input signal s with the impulse response of the cutting-free environment surrounding the sensor h:

$$y=h\otimes s+n \tag{1}$$

where the measured signal y also includes white noise n of the borehole.

The surrounding borehole is considered as weakly dispersive over the bandwidth of the excitation signal. As a result, the impulse response of the borehole due to interaction with the excitation signal may be approximated by a constant amplitude and delay. Accordingly, a matched filter theory may apply, and an optimal amplitude A* and delay τ* of a reconstructed signal, corresponding to an expected returned signal obtained from the borehole may be estimated. This estimation can be expressed as:

$$A^*, \tau^* = \underset{A,\tau}{\operatorname{argmax}}\left[\sum_k (y_k - A\tilde{s}_{k-2\pi f\tau})^2\right] \tag{2}$$

where:

$\tilde{s}$ is a matched filter signal of the excitation signal, i.e., a conjugated time-reversed signal of the excitation signal;

k refers to a $k^{th}$ reference time period ($y_k$ for the measured returned signal during the $k^{th}$ reference time period for instance); and f is the emission frequency of the signal.

In either the acoustic measurement or the electromagnetic measurement embodiments, an optimal amplitude and delay may be estimated based on Equation (2). The estimated amplitude and time delay may be reused to compute the reconstructed signal, i.e. expected returned signal:

$$z = A\tilde{s}_{k-2\pi f\tau} \tag{3}$$

The reconstructed signal may enable an estimate of noise of the measurement:

$$\hat{n} = y - z \tag{4}$$

The processor 46 then performs statistical processing (block 108) on the estimated noise. If there is no occurrence of rapid perturbation (e.g., due to cuttings 64 interfering with measurement of the excitation signal), then the estimated noise may primarily include white noise. If rapid perturbation occurs, then the estimated noise may exhibit clear signatures of the cuttings 64 (as opposed to the white noise). The statistical processing is performed for quantifying a probability that the estimated noise corresponds to a white noise of the borehole.

The statistical processing may include a sequence of computations that enable quantifying a probability that the estimated noise is not the white noise. A feature of the noise that may be evaluated is a null auto-covariance of a time series, which means the noise of each sample of signal (taken during a reference period) is independent of the noise of the other samples. A Ljung-Box test expresses this as a statistical test. However, other statistical tests (named Q-test) expressing account this property may be used (such as Bartlett test for instance). For the time series of length m (signal having m samples of length having a reference time period T), the quantity Q is a statistical variable (value of a $\chi^2$ function) representative of a probability that the estimated is not the white noise of the borehole is calculated using the following formula:

$$Q = m(m+2)\sum_{k=1}^{M}\frac{\rho_k}{m-k} \tag{5}$$

where:

$$\rho_k = \frac{\mathbb{E}[\hat{n}_t\hat{n}_{t+k}]}{\mathbb{E}[\hat{n}_t^2]} = \frac{\mathrm{cov}(\hat{n}_t, \hat{n}_{t+k})}{\mathrm{var}(\hat{n}_t)} \tag{6}$$

Where:

M is a number of samples considered in the test;

t0 is the initial time of the processed signal; and $\hat{n}_t$ is the estimated noise at time t.

As already indicated, the quantity Q follows a chi-squared distribution having a known number of degrees of freedom asymptotically, more particularly M−2, i.e. the number of samples considered minus the two variables that were estimated (A*, τ*). From the value of Q and the number of degrees of freedom, the probability that the noise is white noise may be obtained by known statistical tables. The method may therefore include determining the probability. This operation is however not mandatory. Indeed, as the number of degrees of freedom may be fixed if the number of the considered samples in the test are always the same, the identification of cuttings may be done using directly the statistical variable Q as will be described below.

Figure 6:
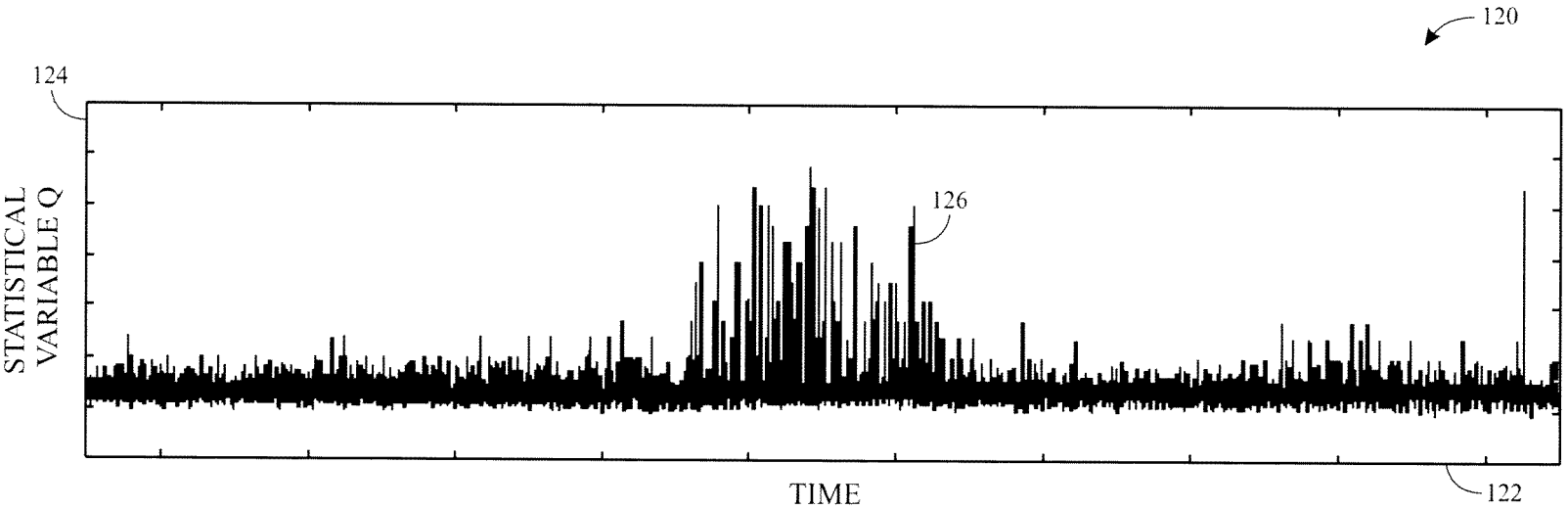
FIG. 6 is a plot of a statistical variable computed based on a measurement by a sensor of a downhole tool, in accordance with an embodiment of the present disclosure.

Once a variable representative of the probability is obtained, it is then possible to identify (block 110) a cutting in a predetermined location of the borehole. The predetermined location may be the area of sensitivity of the sensor, ie the area in which the cuttings interfer with the measurement. This operation includes comparing the variable (the probability itself, or Q as estimated above, for instance) with a predetermined threshold, to determine whether the probability is in a predetermined range. In an embodiment of the disclosure, identifying the cuttings comprises plotting the statistical variable Q versus time. Turning now to FIG. 6, a plot 120 resulting from the statistical processing performed on a measurement by a sensor 42 of a downhole tool 36 in accordance with an embodiment of the present disclosure. The plot includes a horizontal axis 122 representing time and a vertical axis 124 representing the statistical variable Q as determined in the Equations (5)-(6). As illustrated by the plot, the statistical variable Q shows sharp spikes with large amplitudes 126 when a cutting passes in front of the sensor (i.e., in the predetermined area). Such spikes may enable thresholding and/or outlier-detection techniques to accurately identify the cuttings 64. In other words, it is considered that cuttings are identified when the statistical variable Q is in a predetermined range.

When cuttings are identified, information on the presence of the cuttings in front of the sensor may be used to derive (block 112) at least an indicator relative to drilling the borehole. Decision relative to the drilling may be taken using such an indicator. The indicator may be computed only on the basis of the cutting identification data or on the basis of the cutting identification data and of other parameters relative to the borehole, to the drilling installation or combination thereof. For instance, an indicator relative to hole cleaning may be derived. Such indicator may be the number of cuttings detected over time. When such an indicator reaches a steady value, the operators on the rig state may for instance decide to stop the hole cleaning. Alternately, such indicator may be the time of the last detected cutting. An alarm may be raised when the indicator fulfills predetermined conditions (for instance, when a certain time period has expired since the detection of the last cutting). Other indicators for monitoring other drilling parameters may be obtained taking into account the cuttings detection.

In the case of the acoustic measurement, the acoustic measurement may be performed by an acoustic transceiver 60. In particular, the acoustic transceiver 60 may emit a Gaussian pulse excitation signal, and the acoustic measurement may experience an abrupt change because of cuttings 64 interfering with the emission of the excitation signal 68 and/or the detection of the corresponding returned signal 70. In the case of the electromagnetic measurement, the electromagnetic measurement may be performed by an electromagnetic transceiver 80 and receiver 82. In particular, the electromagnetic transmitter 80 may emit a monofrequency excitation signal, and the electromagnetic measurement may experience an abrupt change because of cuttings 64 interfering with the emission of the excitation signal 84 and/or the detection of the corresponding returned signal 86. It is to be noted that such a technique is valid for any measurement type (for instance, acoustic or electromagnetic) and/or for any excitation signal.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

In particular, the disclosure relates to a method comprising emitting, with one or more sensors of a downhole tool disposed in a borehole, an excitation signal; detecting, with the one or more sensors, a returned signal resulting from interaction of the excitation signal with the borehole; estimating a noise of the returned signal; quantifying a probability that the estimated noise is not a white noise of the borehole; and identifying drill cuttings in a predetermined location of the borehole based on said quantification.

In an embodiment, identifying drill cuttings may comprise comparing a variable representative of said probability to at least a predetermined threshold.

In an embodiment, estimating the noise may include modelling a function representing a reconstructed signal coming from the borehole in response to the excitation signal, the function having at least two adjustable variables, determining the adjustable variables based on the returned signal, for instance by using a matched filter theory, and estimating the noise based on the returned signal and the reconstructed signal.

In an embodiment, quantifying the probability is performed using a statistical Q-test for the estimated noise, such as a Ljung-Box test.

Emitting the excitation signal may comprise emitting an acoustic excitation signal, such as an ultrasonic excitation signal, and/or an electromagnetic signal. The excitation signal may be a Gaussian pulse signal or a monofrequency signal, for instance. It may be emitted for a duration of between 10 microseconds and 10 milliseconds.

In an embodiment, the method may comprise deriving from the identification of cuttings an indicator relative to the drilling of the borehole, such as an indicator relative to hole cleaning.

The disclosure also relates to a system comprising a downhole tool disposed in a borehole, comprising one or more sensors, at least one of the sensors being configured to:

emit an excitation signal in the borehole, and detect a returned signal resulting from an interaction of the excitation signal with the borehole, and a processor configured to process the returned signal to:

estimate a noise of the returned signal, quantify a probability that the estimated noise is not a white noise of the borehole, and identify drill cuttings in a predetermined location of the borehole based on said quantification.

The sensors may comprise an acoustic transmitter and an acoustic receiver and/or an electromagnetic transmitter and one or more electromagnetic receivers. They may be dimensioned to provide an area of sensitivity on an order of one inch in front of the one or more sensors.

The disclosure also relates to a tangible, non-transitory, machine-readable medium, comprising machine readable instructions to:

emit, with one or more sensors of a downhole tool disposed in a borehole, an excitation signal;

detect, with the one or more sensors, a returned signal resulting from an interaction of the excitation signal with the borehole;

estimate a noise of the returned signal, quantify a probability that the estimated noise is not a white noise of the borehole, and identify drill cuttings in a predetermined location of the borehole based on said quantification.

The invention claimed is:

1. A method comprising:

emitting, with one or more sensors of a downhole tool disposed in a borehole, an excitation signal;

detecting, with the one or more sensors, a returned signal resulting from interaction of the excitation signal with the borehole;

estimating a noise of the returned signal;

quantifying a probability that the estimated noise is not a white noise of the borehole; and identifying drill cuttings in a predetermined location of the borehole based on said quantification.

2. The method according to the preceding claim, wherein identifying drill cuttings comprises comparing a variable representative of said probability to at least a predetermined threshold.

3. The method according to claim 1, wherein estimating the noise includes:

modelling a function representing a reconstructed signal coming from the borehole in response to the excitation signal, the function having at least two adjustable variables, determining the adjustable variables based on the returned signal, and estimating the noise based on the returned signal and the reconstructed signal.

4. The method according to claim 3, wherein determining the adjustable variables is performed using a matched filter theory.

5. The method according to claim 1, wherein quantifying the probability is performed using a statistical Q-test for the estimated noise.

6. The method according to claim 5, wherein the statistical Q-test is a Ljung-Box test.

7. The method according to claim 1, wherein emitting the excitation signal comprises emitting an acoustic signal.

8. The method according to claim 7, wherein the acoustic signal is an ultrasonic signal.

9. The method according to claim 1, wherein emitting the excitation signal comprises emitting an electromagnetic signal.

10. The method according to claim 1, wherein the excitation signal is a Gaussian pulse excitation signal or a monofrequency excitation signal.

11. The method according to claim 1, wherein emitting the excitation signal comprises emitting the excitation signal for a duration of between 10 microseconds and 10 milliseconds.

12. The method according to claim 1, comprising deriving from the identification of cuttings an indicator relative to a drilling of the borehole.

13. The method according to claim 12, wherein the drilling indicator is an indicator relative to hole cleaning.

14. A system comprising:

a downhole tool disposed in a borehole, comprising one or more sensors, at least one of the sensors being configured to:

emit an excitation signal in the borehole, and detect a returned signal resulting from an interaction of the excitation signal with the borehole, a processor configured to process the returned signal to:

estimate a noise of the returned signal, quantify a probability that the estimated noise is not a white noise of the borehole, and identify drill cuttings in a predetermined location of the borehole based on said quantification.

15. The system of claim 14, wherein the one or more sensors comprise an acoustic transmitter and an acoustic receiver.

16. The system according to claim 14, wherein the one or more sensors comprise an electromagnetic transmitter and one or more electromagnetic receivers.

17. The system according to claim 14, wherein the one or more sensors of the downhole tool are dimensioned to provide an area of sensitivity between 0.5 and 5 inches in front of the one or more sensors.

18. A tangible, non-transitory, machine-readable medium, comprising machine readable instructions to:

emit, with one or more sensors of a downhole tool disposed in a borehole, an excitation signal;

detect, with the one or more sensors, a returned signal resulting from an interaction of the excitation signal with the borehole;

estimate a noise of the returned signal, quantify a probability that the estimated noise is not a white noise of the borehole, and identify drill cuttings in a predetermined location of the borehole based on said quantification.

* * * * *